US005792470A

United States Patent [19]

Baumgardner, Sr.

[11] Patent Number: 5,792,470

[45] Date of Patent: Aug. 11, 1998

[54] EDIBLE CONTAINER FOR ADMINISTERING MEDICATION TO ANIMALS

[76] Inventor: Merwyn J. Baumgardner, Sr., P.O. Box 1404, San Ramon, Calif. 94583

[21] Appl. No.: 694,036

[22] Filed: Aug. 8, 1996

[51] Int. Cl.[6] ..... A61D 7/00

[52] U.S. Cl. ..... 424/442; 424/439; 426/2; 426/72; 426/805

[58] Field of Search ..... 424/438, 439, 424/442; 206/828, 528; 426/2, 72, 805

[56] References Cited

U.S. PATENT DOCUMENTS 3,844,285 10/1974 Laby .
4,381,780 5/1983 Holloway .
4,857,333 8/1989 Harold .
5,100,651 3/1992 Boyer ..... 424/52
5,296,209 3/1994 Simone et al. ..... 424/59
5,378,471 1/1995 Smith ..... 424/442
5,407,661 4/1995 Simone et al. ..... 424/49

*Primary Examiner*—S. Mark Clardy
*Assistant Examiner*—Robert H. Harrison

[57] ABSTRACT

A new Edible Container For Administering Medication To Animals for administering medication to a pet without the pet realizing the presence of the medication, where the medication may comprise pills, powder, liquid, or other substances. The inventive device includes a length of a swaged tubular member the size of which the animal may consume and where the swaged tubular member is constructed from an tasty edible material which conceals the medication within, and an impermeable wrapper removably encloses the length of swaged tubular member.

12 Claims, 3 Drawing Sheets

10

20
22
24
12

10
20
22
24
12

EDIBLE CONTAINER FOR ADMINISTERING MEDICATION TO ANIMALS

BACKGROUND OF THE INVENTION

1. Field of the Invention

The present invention relates to Pet Medication Devices and more particularly pertains to a new Edible Container For Administering Medication To Animals for administering medication to a pet without the pet realizing the presence of the medication, where the medication may comprise pills, powder, liquid, or other substances.

2. Description of the Prior Art

The use of Pet Medication Devices is known in the prior art. More specifically, Pet Medication Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Pet Medication Devices include U.S. Pat. No. 4,163,065; U.S. Pat. No. 4,857,333; U.S. Design Patent 320,495; U.S. Pat. No. 5,407,661; U.S. Pat. No. 4,551,329 and U.S. Pat. No. 4,438,764.

While these devices fulfill their respective, particular objectives and requirements, the aforementioned patents do not disclose a new Edible Container For Administering Medication To Animals. The inventive device includes a length of a swaged tubular member the size of which the animal may consume and where the swaged tubular member is constructed from an tasty edible material which conceals the medication within, and an impermeable wrapper removably encloses the length of swaged tubular member.

In these respects, the Edible Container For Administering Medication To Animals according to the present invention substantially departs from the conventional concepts and designs of the prior art, and in so doing provides an apparatus primarily developed for the purpose of administering medication to a pet without the pet realizing the presence of the medication, where the medication may comprise pills, powder, liquid, or other substances.

SUMMARY OF THE INVENTION

In view of the foregoing disadvantages inherent in the known types of Pet Medication Devices now present in the prior art, the present invention provides a new Edible Container For Administering Medication To Animals construction wherein the same can be utilized for administering medication to a pet without the pet realizing the presence of the medication, where the medication may comprise pills, powder, liquid, or other substances.

The general purpose of the present invention, which will be described subsequently in greater detail, is to provide a new Edible Container For Administering Medication To Animals apparatus and method which has many of the advantages of the Pet Medication Devices mentioned heretofore and many novel features that result in a new Edible Container For Administering Medication To Animals which is not anticipated, rendered obvious, suggested, or even implied by any of the prior art Pet Medication Devices, either alone or in any combination thereof.

To attain this, the present invention generally comprises a length of a swaged tubular member the size of which the animal may consume and where the swaged tubular member is constructed from an tasty edible material which conceals the medication within, and an impermeable wrapper removably encloses the length of swaged tubular member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Edible Container For Administering Medication To Animals apparatus and method which has many of the advantages of the Pet Medication Devices mentioned heretofore and many novel features that result in a new Edible Container For Administering Medication To Animals which is not anticipated, rendered obvious, suggested, or even implied by any of the prior art Pet Medication Devices, either alone or in any combination thereof.

It is another object of the present invention to provide a new Edible Container For Administering Medication To Animals which may be easily and efficiently manufactured and marketed.

It is a further object of the present invention to provide a new Edible Container For Administering Medication To Animals which is of a durable and reliable construction.

An even further object of the present invention is to provide a new Edible Container For Administering Medication To Animals which is susceptible of a low cost of manufacture with regard to both materials and labor, and which accordingly is then susceptible of low prices of sale to the consuming public, thereby making such Edible Container For Administering Medication To Animals economically available to the buying public.

Still yet another object of the present invention is to provide a new Edible Container For Administering Medication To Animals which provides in the apparatuses and methods of the prior art some of the advantages thereof, while simultaneously overcoming some of the disadvantages normally associated therewith.

Still another object of the present invention is to provide a new Edible Container For Administering Medication To Animals for administering medication to a pet without the pet realizing the presence of the medication, where the medication may comprise pills, powder, liquid, or other substances.

Yet another object of the present invention is to provide a new Edible Container For Administering Medication To Animals which includes a length of a swaged tubular member the size of which the animal may consume and where the swaged tubular member is constructed from an tasty edible material which conceals the medication within, and an impermeable wrapper removably encloses the length of swaged tubular member.

Still yet another object of the present invention is to provide a new Edible Container For Administering Medication To Animals that is easy to administer medication to the owner's pets.

Even still another object of the present invention is to provide a new Edible Container For Administering Medication To Animals that can be impregnated with vitamins for the health of the pet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
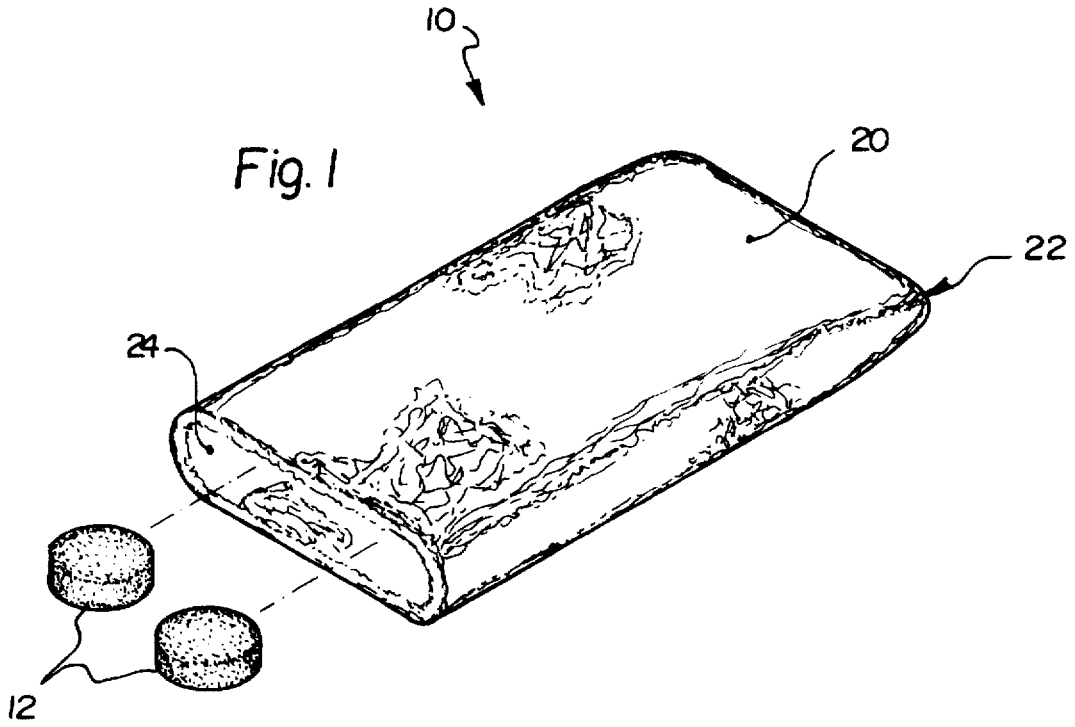
FIG. 1 is a right side perspective view of a new Edible Container For Administering Medication To Animals according to the present invention.
Figure 2:
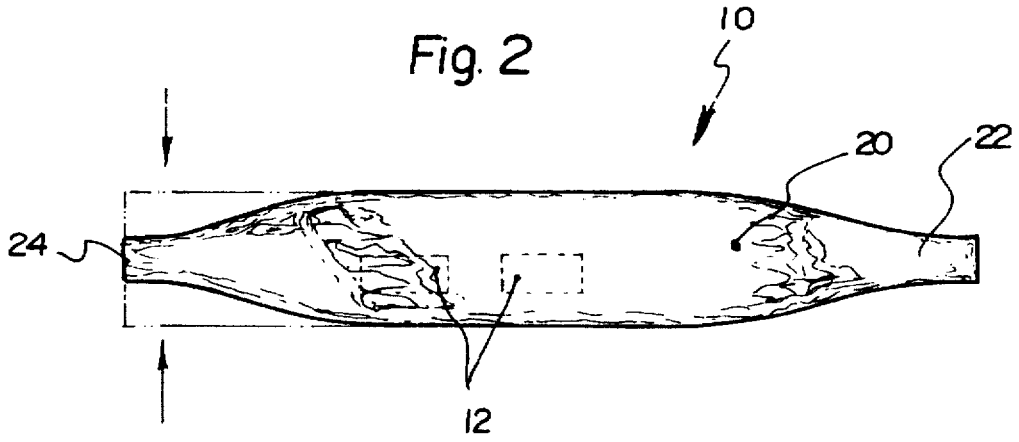
FIG. 2 is a side view thereof.
Figure 3:
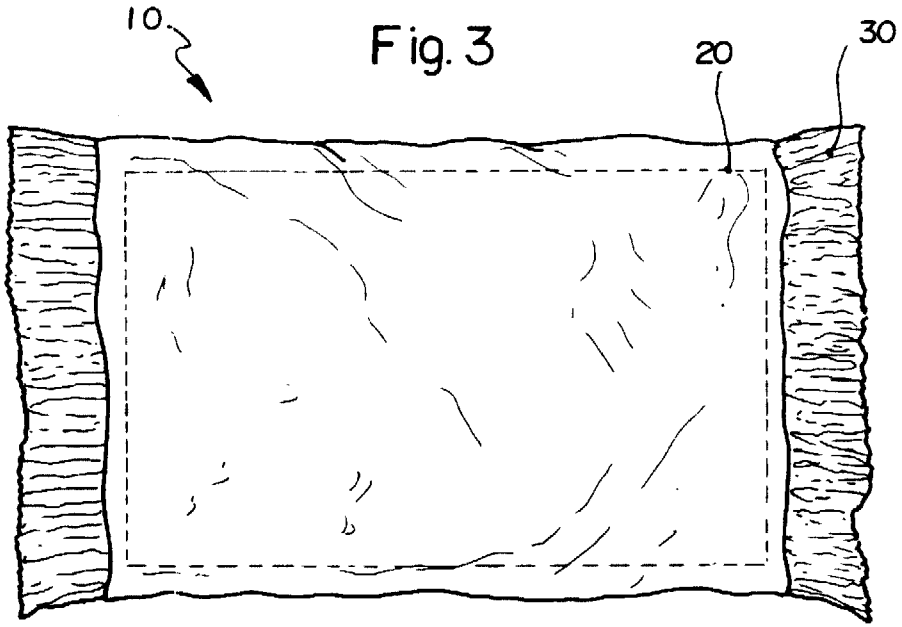
FIG. 3 is a top view of the impermeable wrapper surrounding the swaged tubular member.
Figure 4:
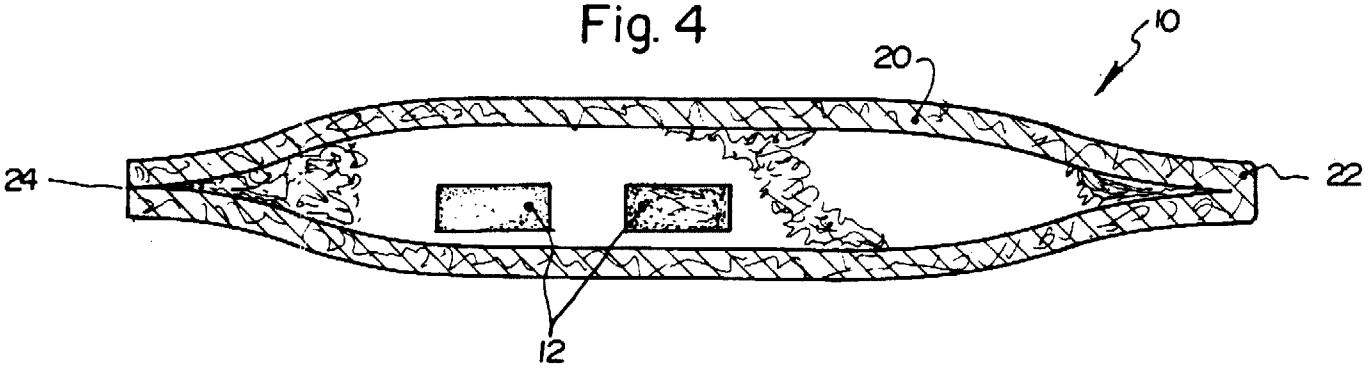
FIG. 4 is a cross sectional view taken along line 4—4 of FIG. 2.
Figure 5:
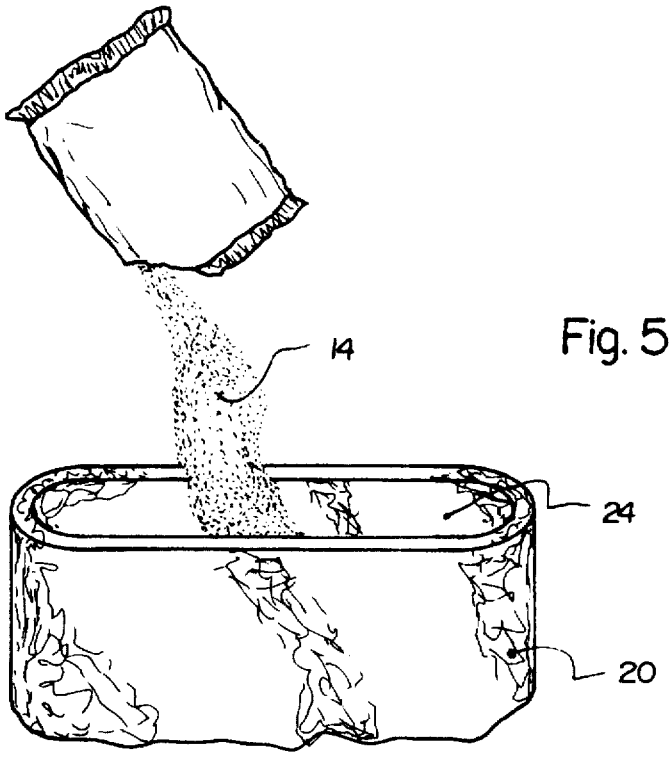
FIG. 5 is an side elevation view of the present invention receiving medication in powder form.
Figure 6:
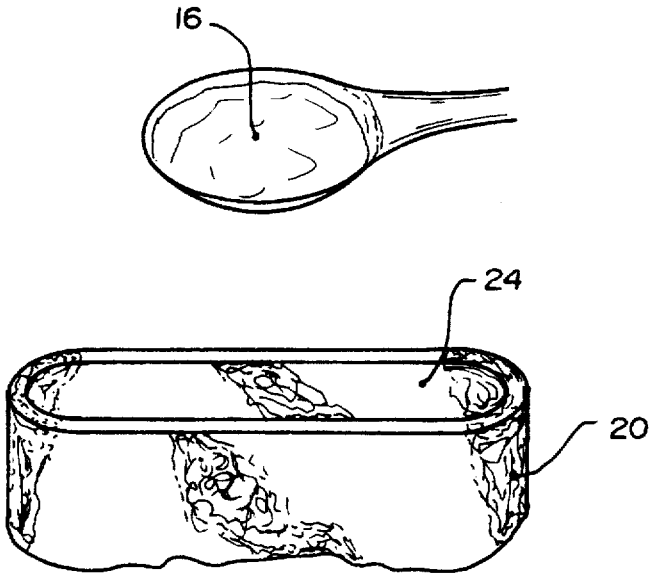
FIG. 6 is an side elevation view of the present invention receiving medication in liquid form.

With reference now to the drawings, and in particular to FIGS. 1 through 6 thereof, a new Edible Container For Administering Medication To Animals embodying the principles and concepts of the present invention and generally designated by the reference numeral 10 will be described.

More specifically, it will be noted that the Edible Container For Administering Medication To Animals 10 comprises a length of a swaged tubular member 20 constructed from an edible material for an animal, the length of swaged tubular member 20 where the ends receive medication in such forms as pills 12, powder 14, liquid 16, or other forms, and the length of swaged tubular member 20 where both ends may be sealed by contracting the upper and lower portions together.

As best illustrated in FIGS. 1 through 4, it can be shown that the length of swaged tubular member 20 may be cut to a desired length by the user for various sizes of animals to consume. As best shown in FIG. 1 of the drawings, the length of swaged tubular member 20 preferably includes a closed end 22 thereby forming a medication storage pocket. The length of swaged tubular member 20 preferably includes an open oval end 24 opposite of the closed end 22 which receives the medication and may be sealed by contracting the upper and lower portions together. The length of swaged tubular member 20 is preferably constructed from a soft permeable material. The length of swaged tubular member 20 is further preferably constructed from a material which has fiber characteristics which are desirable to the animal. The length of swaged tubular member 20 preferably is constructed with various flavors which the animal desires. The length of swaged tubular member 20 is preferably constructed from material which includes at least one essential vitamin for the animal. The length of swaged tubular member 20 may also be constructed from a material which has a beef flavor, texture, and color. An impermeable wrapper 30 removably encloses the swaged tubular member.

In use, the user positions the medication 12, 14, or 16 into the medication pocket within the swaged tubular member 20. The user then squeezes the upper and lower portions of the open oval end 24 together thereby sealing the medication 12, 14, or 16 within the swaged tubular member 20. The user then distributes the present invention containing the medication 12, 14, or 16 to the animal for consumption. The animal chews the present invention thereby consuming the medication 12, 14, or 16 therewith.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An edible container for administering medication to animals comprising:

a length of an oval-shaped tubular member having a first end, said first end being closed, said length of tubular member being constructed from a material adapted for facilitating ingestion of the tubular member by an animal;

said length of tubular member having a second end adapted to receive medication in the form of pills, powder, or liquid; and the second end of said tubular member being sealable by contracting an upper and a lower portion of said second end together, whereby the medication is held within an interior of said tubular member.

2. The edible container for administering medication to animals of claim 1, wherein the length of member is parable to a desired length to facilitate ingestion by various sizes of animal.

3. The edible container for administering medication to animals of claim 2, wherein the length of tubular member is constructed from a material, said material being adapted to allow passage therethrough of objects of a pre-determined size.

4. The edible container for administering medication to animals of claim 3, wherein the material is fibrous for facilitating digestion of the tubular member by the animal.

5. The edible container for administering medication to animals of claim 4, wherein the said material is flavored to facilitate ingestion of the tubular member by the animal.

6. The edible container for administering medication to animals of claim 5, wherein the material includes at least one vitamin.

7. The edible container for administering medication to animals of claim 6, wherein the material is beef flavored, said material further adapted to have a texture and color such that said material resembles beef.

8. The edible container for administering medication to animals of claim 7, wherein an impermeable wrapper removably encloses the tubular member.

9. An edible container for administering medication to an animal, the container comprising:

a tubular member having a closed end and an interior, said interior being adapted to receive medication in the form of a powder, a liquid or a number of pills;

said tubular member having an open end positioned opposite said closed end;

said open end being sealable by pinching opposing edges of said open end towards each other such that the medication is enclosed by said tubular member;

said tubular member further being constructed of a fibrous and malleable material.

10. The edible container of claim 9 wherein said material is flavored to facilitate ingestion of the tubular member by the animal.

11. The edible container of claim 9, wherein the material contains at least one vitamin.

12. The edible container of claim 10, further comprising the material being textured and flavored to resemble beef.

* * * * *